US005141422A

United States Patent [19]

Ito et al.

[11] Patent Number: 5,141,422

[45] Date of Patent: Aug. 25, 1992

[54] SCROLL-TYPE COMPRESSOR HAVING COOLING AND LUBRICATION HOLES TO VARIOUS MECHANISMS

[75] Inventors: Yoshiyasu Ito; Takayuki Iio, both of Aichi, Japan

[73] Assignee: Mitsubishi Jukogyo Kabushiki Kaisha, Tokyo, Japan

[21] Appl. No.: 687,948

[22] Filed: Apr. 19, 1991

[30] Foreign Application Priority Data

Aug. 21, 1990 [JP] Japan ..... 2-219733

[51] Int. Cl.[5] ..... F04C 18/04; F04C 29/02

[52] U.S. Cl. ..... 418/55.3; 418/55.6; 418/100

[58] Field of Search ..... 418/55.3, 55.6, 100

[56] References Cited

U.S. PATENT DOCUMENTS 4,484,869 11/1984 Nakayama et al. ..... 418/55.6
4,538,975 9/1985 Tsukagoshi ..... 418/55.6

FOREIGN PATENT DOCUMENTS 59-52193 4/1984 Japan .
60-135684 7/1985 Japan ..... 418/100
1-178784 7/1989 Japan ..... 418/55.3

*Primary Examiner*—John J. Vrablik

[57] ABSTRACT

A scroll-type compressor has a ring-shaped protruding portion of a front case is fitted into an opening end of a case body so as to construct a housing, a stationary scroll and a revolving scroll which are engaged with each other when they are disposed in the housing. The stationary scroll is fixed to the housing, and at the same time, the revolving scroll is made to revolve in solar motion by a revolution drive mechanism from a rotary shaft while checking rotation on its axis of the revolving scroll by a rotation check mechanism. More particularly, a compressor in which a gas suction port is opened at a location where the ring-shaped protruding portion of the case body is engaged and at least one and more draught holes including a through hole which penetrates to the inside opposing to the suction port are provided on the ring-shaped protruding portion. It is thereby possible to improve cooling and lubrication of the rotation check mechanism and the revolution drive mechanism.

20 Claims, 2 Drawing Sheets

SCROLL-TYPE COMPRESSOR HAVING COOLING AND LUBRICATION HOLES TO VARIOUS MECHANISMS

FIELD OF THE INVENTION AND RELATED ART STATEMENT

The present invention relates to a scroll-type compressor.

FIG. 2 shows an example of a conventional scroll-type gas compressor.

In FIG. 2, a housing 1 consists of a case body 2, a front case 4 fitted securely to the case body 2 with bolts not shown, and a front cover 6 fitted securely to the front case 4 with a bolt 5. A ring-shaped protruding portion 4*a* of the front case 4 is engaged with an opening end of the case body 2. A rotary shaft 7 penetrates through the front cover 6, and is supported rotatably by the housing 1 through a bearing 8 interposed between the front cover 6 and the rotary shaft 7 and a bearing 9 interposed between a boss 7*a* of the rotary shaft 7 and the front case 4.

A stationary scroll 10 and a revolving scroll 14 are installed inside the housing 1.

The stationary scroll 10 is provided with an end plate 11 and a spiral wrap 12 which is set up on the inside surface thereof, and the outer circumferential surface of the end plate 11 is made to come into close contact with the inner circumferential surface of the case body 2 and securely fitted hermetically thereto with a bolt 13. With this, a discharge cavity 31 is defined on the outside of the end plate 11 and a suction chamber 32 is defined inside thereof.

The revolving scroll 14 is provided with an end plate 15 and a spiral wrap 16 which is set up on the inner surface thereof, and the spiral wrap 16 has a substantially identical configuration as the spiral wrap 12 mentioned above.

The revolving scroll 14 and the stationary scroll 10 are eccentric from each other by the radius of revolution and are engaged with each other while shifting the angle by 180° as shown in the figure. Chip seals 17 which are embedded in the point face of the spiral wrap 12 come in close contact with the inner surface of the end plate 15, and chip seals 18 which are embedded in the point face of the spiral wrap 16 come in close contact with the inner surface of the end plate 11. Side surfaces of the spiral wraps 12 and 16 are in linear contact with each other at several locations. In such a manner, a plurality of tightly closed small chambers 19*a* and 19*b* forming almost a point symmetry with respect to the center of the spiral are defined.

A bushing 21 is fitted rotatably inside a cylindrical boss 20 which is protruded at the central part of the outer surface of the end plate 15 through a rotary bearing 23. An eccentric pin 25 protruded at the inner end of the rotary shaft 7 is engaged rotatably with an eccentric hole 24 which is bored in the bushing 21. Further, a balance weight 27 is fixed to the bushing 21.

A rotation check mechanism 26 which also serves as a thrust receiving member is interposed between the outer circumferential edge of the outer surface of the end plate 15 and the end surface of the ring-shaped protruding portion 4*a* of the front case 4.

A sub-balance weight 40 is fitted securely to a boss 7*a* of the rotary shaft 7.

A suction chamber 35 and a discharge chamber 34 are formed in the case body 2, in which the suction chamber 35 communicates with the suction chamber 32 through a suction port 37 which is bored at a location opposing to the outer circumferences of spiral wraps 12 and 16, and the discharge chamber 34 communicates with the discharge cavity 31 through a through hole 36.

Then, when the rotary shaft 7 is rotated, the revolving scroll 14 is driven through a revolution drive mechanism consisting of the eccentric pin 25, the bushing 21, the rotary bearing 23, the boss 20 and the like. Further, the revolving scroll 14 performs revolution in solar motion while being checked to rotate on its axis by means of the rotation check mechanism 26.

The linear contact portion between spiral wraps and 16 moves gradually toward the center of the spiral with the revolution in solar motion of the revolving scroll 14. As a result, the tightly closed small chambers 19*a* and 19*b* move toward the center of the spiral while decreasing the volumes thereof.

Then, a gas is suctioned into the suction chamber 32 through the suction chamber 35 and the suction port 37, and taken into the tightly closed small chambers 19*a* and 19*b* from the opening portions at outer terminals of spiral wraps 12 and 16, thus reaching a central chamber 22 while being compressed. The gas passes through a discharge port 29 which is bored on the end plate 11 of the stationary scroll 10 is discharged into the discharge cavity 31 by pushing open a discharge valve 30, and flows out through the through hole 36 and the discharge chamber 34.

In a conventional scroll-type compressor mentioned above, respective sliding parts are cooled and lubricated by lubricating oil contained in a suctioned gas. However, since the suctioned gas enters into the suction chamber 32 through the suction port 37 disposed so as to oppose to the outer circumferences of the spiral wraps 12 and 16 and is taken into the tightly closed small chambers 19*a* and 19*b* through the opening at the outer terminal of the spiral wrap 16, there has been such a problem that lubrication and cooling of the rotation check mechanism 26, bushing 21, the rotary bearing 23, the eccentric hole 24, the eccentric pin 25 and the like which form the revolution drive mechanism of the revolving scroll 14 are liable to be insufficient.

OBJECT AND SUMMARY OF THE INVENTION

It is an object of the present invention which has been made in view of above-mentioned points to provide a scroll-type compressor in which the above-mentioned problems have been solved.

Essential points of the present invention exist in a scroll-type compressor in which a ring-shaped protruding portion of a front case is fitted into an opening end of a case body so as to construct a housing, a stationary scroll and a revolving scroll which are engaged with each other when they are disposed in the housing, the stationary scroll is fixed to the housing and a thrust receiving member and a rotation check mechanism are interposed between the revolving scroll and an end face of the ring-shaped protruding portion of the front case, and the revolving scroll is made to revolve in solar motion by a rotary shaft supported on the front case through a bearing through a revolution drive mechanism while checking rotation on its axis of the revolving scroll by means of the rotation check mechanism, characterized in that a gas suction port is opened at a location of the case body where the ring-shaped protruding portion is engaged, and at the same time, at least one and more draught holes including a through hole which penetrates inside opposing to the suction port are provided on the ring-shaped protruding portion.

Above-mentioned construction being provided in the present invention, the operation is such that a gas enters into the housing through the suction port and is sent to the revolution drive mechanism, the bearing, the thrust receiving member, the rotation check mechanism and the like through the through hole and cools and lubricates them at the same time.

As it is apparent from the explanation described above, according to the present invention, since a gas suction port is opened at a location where the ring-shaped protruding portion of the case body is fitted and at least one and more draught holes including a through hole which penetrates inside opposing to the suction port are also provided on the ring-shaped protruding portion, the gas enters into the housing through the suction port and is sent to the revolution drive mechanism, the bearing, the thrust receiving member, the rotation check mechanism and the like through the through hole. Thus, it is possible to improve cooling and lubrication and also to improve the reliability thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF A PREFERRED EMBODIMENT

Figure 1:
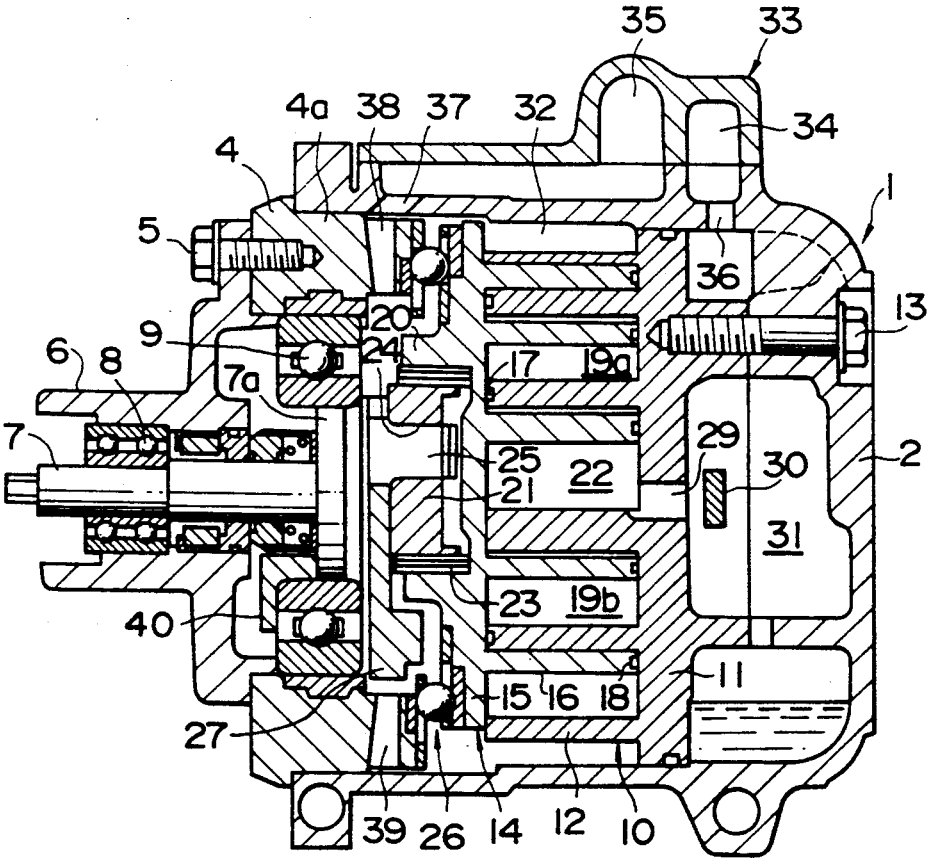
FIG. 1 is a longitudinal sectional view showing an embodiment of the present invention.
Figure 2:
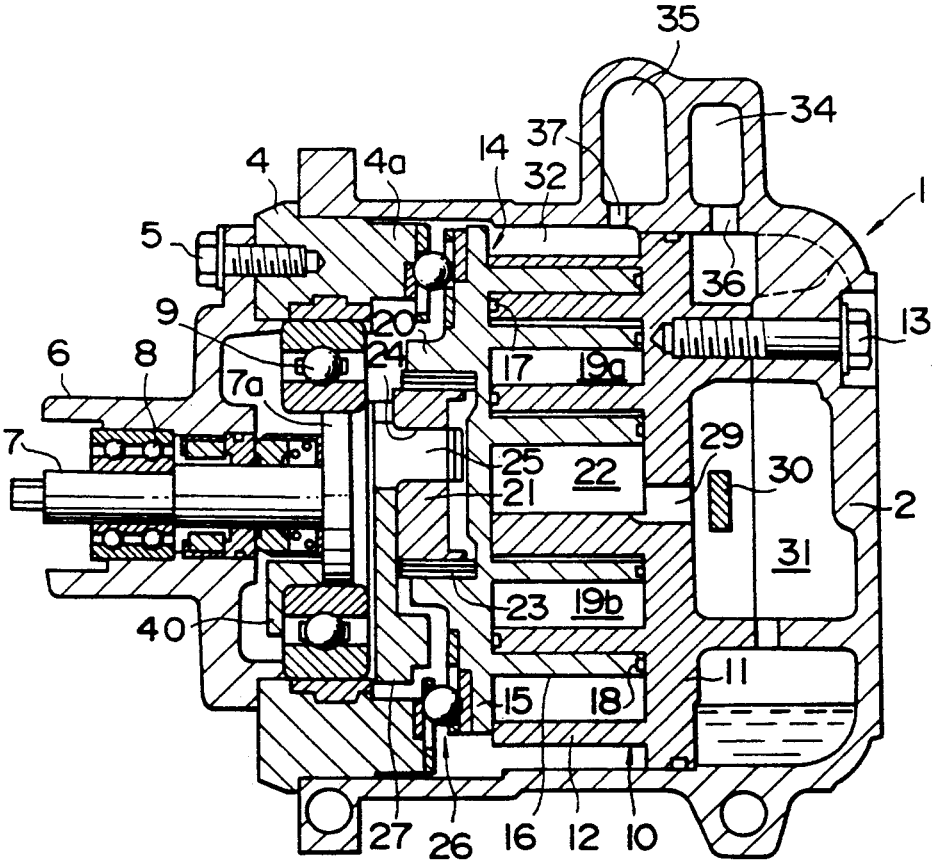
FIG. 2 PRIOR ART
FIG. 2 is a longitudinal sectional view showing a conventional scroll-type compressor.

FIG. 1 shows an embodiment of the present invention.

A fitting block 33 is securely fitted to an outer circumference of a case body 2 with bolts not shown. A discharge chamber 34 and a suction chamber 35 are formed by the case body 2 and the fitting block 33, and the suction chamber 35 extends toward a front case 4 along an axial direction.

A suction port 37 is bored at a location where a ring-shaped protruding portion 4*a* of the front case 4 is engaged, and the suction chamber 35 communicates with the inside of a housing 1 through the suction port 37. Further, the discharge chamber 34 communicates with a discharge cavity 31 through a through hole 36. A through hole 38 which penetrates to the inside opposing to the suction port 37 is bored on the ring-shaped protruding portion 4*a* of the front case 4. It is possible to bore a draught hole 39 at the ring-shaped protruding portion 4*a* other than the through hole 38, and these through hole 38 and draught hole 39 may be formed at the same time as casting draught holes at the time of casting the front case 4.

The suctioned gas enters into the housing 1 through a suction gas pipe not shown, a suction fitting installed on the fitting block 33, the suction chamber and the suction port 37, and a part thereof enters inside through the through hole 38 and is supplied to the bearing 9, the rotary bearing 23, the sliding surface between the eccentric hole 24 and the eccentric pin 25 and the like so as to cool and also lubricate them at the same time.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A scroll-type compressor comprising:

a front case having a ring-shaped protruding portion and a case body with an opened end, the ring-shaped protruding portion of the front case being fitted into the opened end of the case body to form a housing;

a stationary scroll and a revolving scroll engaged with each other and being disposed in the housing, said stationary scroll being fixed to said housing;

a thrust receiving and rotation check mechanism being interposed between said revolving scroll and an end face of the ring-shaped protruding portion of said front case;

a rotary shaft for rotating said revolving scroll in solar motion, the rotary shaft being supported on said front case through a bearing at the ring-shaped protruding portion thereof, and through a revolution drive mechanism while checking rotation on its axis of the revolving scroll by means of said thrust receiving and rotation check mechanism;

a gas suction port being provided on said case body where said ring-shaped protruding portion is engaged therewith; and at least one draught hole including a through hole penetrating the ring-shaped protruding portion, the at least one through hole having a first and second end, the first end being located opposing said suction port and the second end being located between the bearing and the thrust receiving and rotation check mechanism.

2. The scroll-type compressor according to claim 1, wherein a plurality of draught holes including said through hole are provided on an outer circumference of said ring-shaped protruding portion.

3. The scroll-type compressor according to claim 1, wherein said through hole and at least one draught hole are formed as casting draught holes at the time of casting said front case.

4. The scroll-type compressor according to claim 1, further comprising a front cover attached to the front case and a second bearing interposed between the front cover and the rotary shaft, the second end of the at least one through hole being located between the thrust receiving and rotation check mechanism and the second bearing.

5. The scroll-type compressor according to claim 1, wherein the revolution drive mechanism comprises an eccentric pin, a bushing, a rotary bearing and a boss, the eccentric pin being located at an end of the rotary shaft, the rotary shaft having a longitudinal axis and the eccentric pin having a longitudinal axis which is generally parallel to but non-coincident with the longitudinal axis of the rotary shaft, the bushing being attached to the eccentric pin and the rotary bearing being provided between the bushing and the boss, the boss being on the revolving scroll.

6. The scroll-type compressor according to claim 5, wherein a lubricant flows through the suction port and the at least one through hole to the revolution drive mechanism.

7. The scroll-type compressor according to claim 5, further comprising a balance weight fixed to the bushing, the balance weight being located between the bearing and the thrust receiving and rotation check mechanism.

8. The scroll-type compressor according to claim 1, wherein the rotary shaft has a boss on one end thereof, the boss engaging the bearing, the revolution drive mechanism comprises an eccentric pin, the eccentric pin extends from the boss in a direction toward the revolving scroll.

9. The scroll-type compressor according to claim 8, wherein the at least one through hole has a longitudinal axis which intersects the eccentric pin and is generally perpendicular to a longitudinal axis of the rotary shaft.

10. A scroll-type compressor comprising:

a front case having a ring-shaped protruding portion and a case body with an opened end, the ring-shaped protruding portion of the front case being fitted into the opened end of the case body to form a housing;

a stationary scroll and a revolving scroll engaged with each other and being disposed in the housing, the stationary scroll being fixed to said housing;

a thrust receiving and rotation check mechanism being interposed between said revolving scroll and an end face of said ring-shaped protruding portion of said front case;

a rotary shaft for rotating said revolving scroll in a solar motion, the rotation shaft being supported on said front case through a bearing at the ring-shaped protruding portion thereof, and through a revolution drive mechanism while checking rotation on its axis of the revolving scroll by means of said thrust receiving and rotation check mechanism;

a first suction chamber formed on an outer circumference of said case body and a second suction chamber formed by the stationary scroll and the revolving scroll, suction gas in the first suction chamber being drawn to the second suction chamber upon rotation of the revolving scroll, the suction gas is then compressed by the scrolls and discharged from a discharge port;

a gas suction port being formed in the case body where the ring-shaped protruding portion is engaged, the gas suction port being in communication with the first suction chamber;

at least one draught hole including a through hole being formed in the ring-shaped protruding portion, the through hole being in communication with the gas suction port and the thrust receiving and rotation check mechanism such that suction port gas in the first suction chamber flows through the gas suction port and the at least one draught hole and the through hole directly to the thrust receiving and rotation check mechanism and to the second suction chamber thereby cooling and lubricating at least the thrust receiving and rotation check mechanism with the suction gas, the suction gas following a roundabout route to the second suction chamber.

11. The scroll-type compressor according to claim 10, wherein the suction gas flowing from the at least one draught hole and the through hole flows directly to the thrust receiving and rotation check mechanism without first flowing through a bearing.

12. The scroll-type compressor according to claim 10, wherein all of the suction gas entering the compressor passes through the first suction chamber and is discharged through the gas suction port adjacent the ring-shaped protruding portion of the front case.

13. The scroll-type compressor according to claim 10, wherein all of the suction gas entering the compressor passes through the first suction chamber and is discharged through the gas suction port adjacent the ring-shaped protruding portion of the front case.

14. The scroll-type compressor according to claim 10, wherein a plurality of draught holes including said through hole are provided on an outer circumference of said ring-shaped protruding portion.

15. The scroll-type compressor according to claim 10, wherein said through hole and at least one draught hole are formed as casting draught holes during casting of said front case.

16. The scroll-type compressor according to claim 10, wherein the revolution drive mechanism comprises an eccentric pin, a bushing, a rotary bearing and a boss, the eccentric pin being located at an end of the rotary shaft, the rotary shaft having a longitudinal axis and the eccentric pin having a longitudinal axis which is generally parallel to but not-coincident with the longitudinal axis of the rotary shaft, the bushing being attached to the eccentric pin and the rotary bearing being provided between the bushing and the boss, the boss being on the revolving scroll.

17. The scroll-type compressor according to claim 15, wherein the suction gas flows through the gas suction port and the at least one draught hole and the through hole to the revolution drive mechanism as well as the thrust receiving and rotation check mechanism.

18. The scroll-type compressor according to claim 15, further comprising a balance weight fixed to the bushing, the balance weight being located between the bearing and the thrust receiving and rotation check mechanism.

19. The scroll-type compressor according to claim 10, wherein the rotary shaft has a boss on one end thereof, the boss engaging the bearing, the revolution drive mechanism comprises an eccentric pin, the eccentric pin extends from the boss in a direction toward the revolving scroll.

20. The scroll-type compressor according to claim 18, wherein the at least one through hole has a longitudinal axis which intersects the eccentric pin and is generally perpendicular to a longitudinal axis of the rotary shaft.

* * * * *